United States Patent [19]

Verbruggen

[11] Patent Number: 4,576,427

[45] Date of Patent: Mar. 18, 1986

[54] ZERO INSERTION AND EXTRACTION FORCE CONNECTOR

[75] Inventor: Marcel Verbruggen, Londerzell, Belgium

[73] Assignee: Burndy Corporation, Norwalk, Conn.

[21] Appl. No.: 210,719

[22] Filed: Nov. 26, 1980

[30] Foreign Application Priority Data

Nov. 30, 1979 [BE] Belgium ..... 198361

[51] Int. Cl.[4] ..... H01R 9/09

[52] U.S. Cl. ..... 339/61 M; 339/74 R; 339/176 MP

[58] Field of Search ..... 339/59 R, 59 M, 74 R, 339/75 R, 75 M, 75 MP, 61 R, 61 M, 176 MP

[56] References Cited

U.S. PATENT DOCUMENTS

| | | | |
|---|---|---|---|
| 3,594,699 | 7/1971 | Jayne et al. | 339/75 MP |
| 3,710,303 | 1/1973 | Gallagher, Jr. | 339/61 M |
| 4,077,688 | 3/1978 | Cobaugh et al. | 339/74 R |
| 4,179,176 | 12/1979 | Jayne | 339/74 R |
| 4,257,660 | 3/1981 | Chalmers | 339/74 R |

*Primary Examiner*—John McQuade
*Assistant Examiner*—Gary F. Paumen
*Attorney, Agent, or Firm*—Howard S. Reiter

[57] ABSTRACT

An electrical connector for receiving the edge of a printed circuit board or flexible circuit device or the like, has a resiliently displacable wall portion which supports a plurality of electrical contacts. A projection extending outwardly from the wall in the direction of the contacts, engages a printed circuit board as it is inserted into the housing and displaces the wall portion so that the contacts do not engage the surface of the board during insertion. When the board or similar device has been fully inserted, the projections are permitted to enter corresponding recesses on the board so that the wall portion returns to its normal nondisplaced position and the contacts engage cooperating contact surfaces on the board.

4 Claims, 7 Drawing Figures

FIG. 1
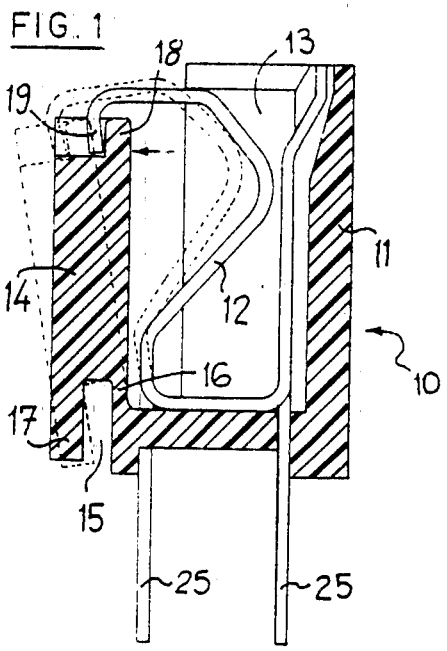
FIG. 2
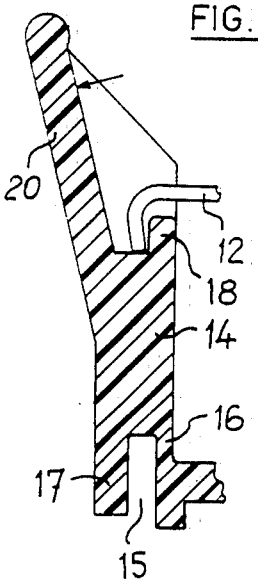
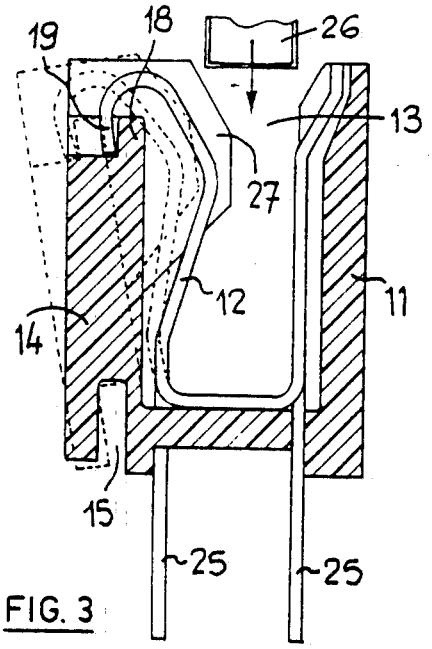
FIG. 3
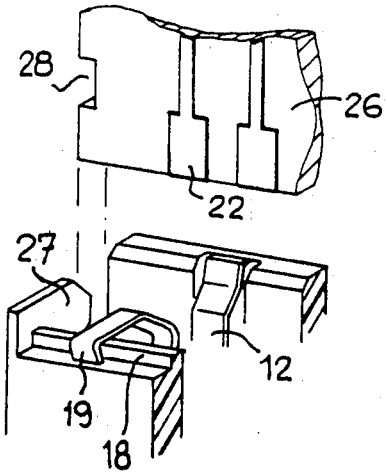
FIG. 4

ZERO INSERTION AND EXTRACTION FORCE CONNECTOR

BACKGROUND OF THE INVENTION (1) Field of the Invention

This invention relates to electrical connectors which are able to achieve electrical connection only when the conductive means are completely positioned in place in the connector and in which the resilient contact members, which are normally closed to hold said conductive means, are opened during the insertion or extraction of the conductive means so as to eliminate insertion and extraction force on the contacts. The conductive means could for instance consist of an insulating bearer (hard or flexible) carrying electrical circuits comprising conductive layers or strips.

This option becomes more and more important due to the recent development of thin flexible circuits provided with "conductive ink circuits" (CIC).

The conductive layers of these flexible printed circuits are extremely thin and could be damaged by the rubbing against the respective contacts when inserting the boards.

Moreover it is not possible to insert such flexible circuits when the force of insertion exceeds the ability of the flexible circuit to resist buckling.

(2) The Prior Art

Several solutions have already been proposed among which:

(a) the rotary or sliding cam actuated zero insertion force connectors, in which a locking device is used to separate the contact members during insertion or extraction of circuit boards (example: U.S. Pat. No. 3,899,234).

(b) pivotally mounted or sliding member which cooperates with the connector housing to put the contact means therein under tension after insertions (example: MOLEX connector series 4850).

In the first mentioned solution, the contact members of the connector are in normally closed position. The locking device used to separate said contacts comprises a plurality of parts to be manufactured separately and to be assembled in the connector housing.

In the second solution, the snapping force of the contact members is conditioned by an external member made of plastic material subject to "creep" and to deformations difficult to verify in time.

SUMMARY OF THE INVENTION

The purpose of the present invention is to provide a very simple and economical connectors able to eliminate insertion and extraction force on the contacts.

It is therefore an object of the invention to produce an electrical connector comprising normally closed contact members and a connector housing molded in one single piece, at least one portion of which is shaped to be resilient.

Another object of the invention is to produce a zero insertion and extraction connector in which the resilient portion of the connector housing cooperates with at least one part of each contact member.

It is still another object of the invention to produce an electrical connector, the resilient portion of which:

is shaped to be actuated by hand;

is shaped to be actuated by any suitable object or tool;

is shaped to be actuated by a hard circuit board itself.

These objects and other details and advantages of the present invention will be set forth in the following description of some practical embodiments with reference to the accompanying drawings in which:

FIG. 1: is a cross-sectional view of a zero insertion and extraction force connector according to the invention. The contact member is shown in closed position in solid lines and in open position in dotted lines.

FIG. 2: is a cross-sectional view of the resilient portion of the connector housing shaped to be hand actuated.

FIG. 3: is a cross-sectional view of an alternate embodiment of a connector according to the invention having a resilient side wall portion shaped to be actuated by the circuit board itself during insertion or extraction operation.

FIG. 4: is a perspective view of detail relating to FIG. 3.

FIG. 5: is a perspective view partially cut away of a practical application of a hand actuated zero insertion and extraction force connector.

FIGS. 6 and 7: are cross-sectional views of further alternative embodiments of the invention.

DETAILED DESCRIPTION

Figure 5:
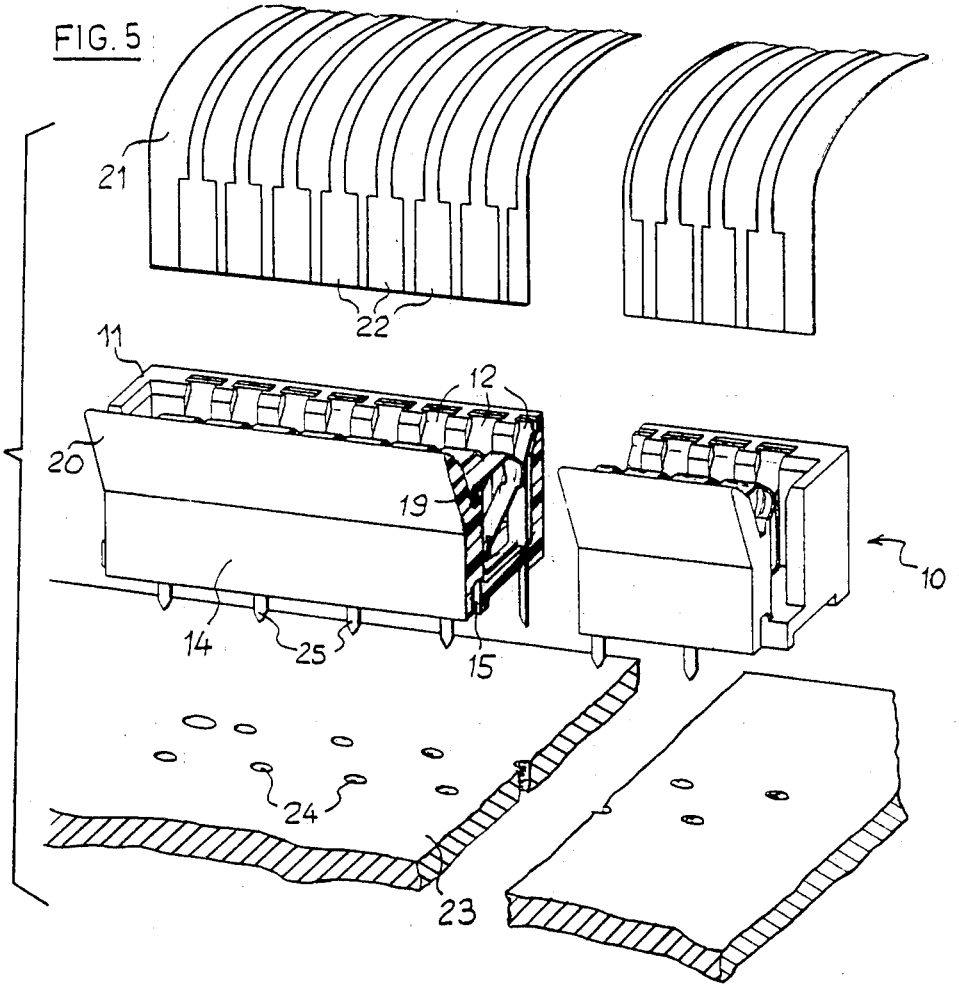

The electric connector 10 shown on FIG. 1 comprises an elongated housing 11 made of insulating material and molded in one single piece. Inside of said housing 11 are mounted a plurality of resilient conductive contact members 12 arranged to receive and hold along the recess 13 of the housing 11 a board 21 with a printed circuit, by which the electrical connection is effected between the conductive strips 22 of the bearer or board 21 (FIG. 5) and the contact surfaces of the resilient contact members 12.

According to the present invention, the extremities of one side wall 14 of the connector housing 11 are separated from the contiguous side walls so that only the lower edge of this side wall 14 remains connected to the connector housing (11).

In order to obtain more flexibility of said side wall 14, a slot 15 is provided in the lower edge between the flexible wall 14 and the housing 11 creating a resilient member 16 connecting the main body 11 to the actuating side wall 14. The remaining part 17 is used as an abutment to prevent excessive bending of the said wall 14.

The upper end of the side wall 14 is provided with a shoulder 18 at the back of which is withheld a folded end 19 of the contact member 12.

The side wall may be actuated by any suitable means and bent sidewards and outwards as illustrated in dotted lines in FIG. 1 so as to carry with it one part of the contact member 12 while inserting a circuit board without applying any insertion force and without rubbing the contact surfaces with the conductive strips of the bearer.

FIG. 2 shows another embodiment of side wall 14, one side of the upper end of which is provided with an extended portion 20. This portion 20 can be easily hand actuated while inserting or extracting the circuit board.

This embodiment is particularly indicated for the use of the connector with thin flexible circuits.

A practical application is illustrated in FIG. 5 in which the connector 10 is of the type providing electrical connection for one flexible circuit 21 having conductive strips or pads 22 thereon and another board 23 having a plurality of through holes 24 through which extend the lower parts 25 of the contact members 12.

Advantageously the lower parts 25 are staggered to give more stability when actuating sidewards the side wall 14.

Figure 6:
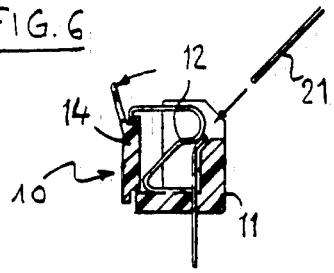
Figure 7:
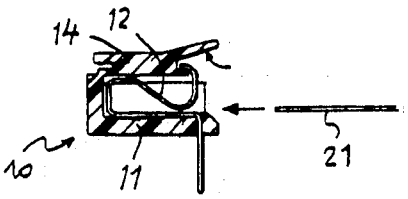

Any other embodiments of connector housing are possible according to the present invention such as shown on FIG. 6 and 7 which are respectively relating to 45° and 90° insertion connectors.

When using a normal hard circuit board 26 (FIG. 3 and 4) the embodiment of the connector housing 10 is arranged so that the flexible side wall 14 is provided with projections 27 extending towards the recess 13 of the housing 10 so as to project slightly beyond the resilient part of the contact member 12.

When inserting a board 26 into the recess 13 of the connector housing, non conductive parts of the board come into contact with the projections 27 and push said projections together with the side wall 14 and the drawn parts of the contact member sidewards in outward direction. In that way the conductive strips 22 are inserted into their position without rubbing against the contact surfaces of the resilient contact members 12. Only when the board 26 is completely in position, the projection come to bear opposite the notched portions 28 of the board and the wall comes back into its starting position so that simultaneously the electrical connection is effected and the board is withheld mechanically in its position by the pressure of the resilient contact members and the cooperation between the projections 27 of the wall 14 and the corresponding notches 28 of the board 26.

Another advantage of this feature consists in that the engaging part of the circuit board needs no more to be chamfered.

Other embodiments of the invention are still possible without departing from the scope of the invention.

I claim:

1. In a hand-actuated zero insertion and extraction force electrical connector having a molded one piece housing and at least one pair of resilient conductive contacts lodged within a channel of such housing, the improvement comprising:

said molded one piece housing having said elongated channel defined by opposing side walls and a base of said housing, one such side wall of said housing being substantially more flexible than the opposing side wall and adapted for hand actuation independant of a tool so as to engage one of the pair of the resilient contacts upon the displacement thereof, said one side wall having an integral abutment means which prevents excessive bending of said one side wall due to hand actuation to displace said one contact, thereby effecting a corresponding displacement of said one resilient conductive contact within the elongated channel away from the opposing contact so as to permit insertion and/or extraction of a printed circuit within said channel with zero force.

2. The electrical connector according to claim 1 characterized in that the extremities of said one side wall of the housing are separated at the ends from the contiguous walls in such a way that said side wall is fixed with only one remaining edge to the housing and the free end of said one side wall is provided with a shoulder at the back of which is withheld a folded end of one part of the resilient contact.

3. The electrical connector according to claim 1 characterized in that said one side wall is provided with an open, substantially lengthwise slot adjacent said base to improve the flexibility of said wall, the portion of said connector on the side of the slot opposite the base operating as an abutment part to prevent excessive bending.

4. The electrical connector according to claim 1, characterized in that said one side wall is provided at its upper edge with a substantially upwards extended portion enabling said wall to be hand actuated while the printed circuit are placed in the connector or are removed therefrom.

* * * * *